US006289809B1

(12) United States Patent
Sonobe

(10) Patent No.: US 6,289,809 B1
(45) Date of Patent: Sep. 18, 2001

(54) BLANKET FOR OFFSET PRINTING AND METHOD OF MANUFACTURING THE SAME

(75) Inventor: Saburo Sonobe, Toride (JP)

(73) Assignee: Kinyosha Co., Ltd., Tokyo (JP)

( * ) Notice: Subject to any disclaimer, the term of this patent is extended or adjusted under 35 U.S.C. 154(b) by 0 days.

(21) Appl. No.: 09/420,432

(22) Filed: Oct. 12, 1999

(30) Foreign Application Priority Data

Oct. 14, 1998 (JP) ..... 10-291950

(51) Int. Cl.[7] ..... B41N 10/04; B41N 6/00; B41N 13/10; B41N 27/06; B41F 7/02

(52) U.S. Cl. ..... 101/401.1; 101/376; 101/217; 428/909

(58) Field of Search ..... 428/909; 101/217, 101/218, 375, 376, 401.1

(56) References Cited

U.S. PATENT DOCUMENTS 3,700,541 * 10/1972 Shrimpton et al. ..... 428/909
4,093,764 * 6/1978 Duckett et al. ..... 428/113
5,768,990 * 6/1998 Vrotacoe et al. ..... 101/217

FOREIGN PATENT DOCUMENTS 63-249696 * 10/1988 (JP) ..... 428/909
5301483 11/1993 (JP) .
6-340187 12/1994 (JP) .
7-1857 1/1995 (JP) .
7-1858 1/1995 (JP) .
8216548 8/1996 (JP) .
2569213 10/1996 (JP) .

* cited by examiner

*Primary Examiner*—Kimberly L. Asher
(74) *Attorney, Agent, or Firm*—Volpe and Koenig, P.C.

(57) ABSTRACT

Disclosed is a blanket for an offset printing, comprising a metallic sleeve, a base layer formed on the metallic sleeve, a compressible rubber layer formed on the base layer, an inextensible layer formed on the compressible rubber layer, and a surface rubber layer formed on the inextensible layer, wherein the inextensible layer consists of a thread that is compressed in advance to 90% to 50% of the original thickness and wound about the compressible layer.

7 Claims, 3 Drawing Sheets

BLANKET FOR OFFSET PRINTING AND METHOD OF MANUFACTURING THE SAME

BACKGROUND OF THE INVENTION

The present invention relates to a blanket for an offset printing and a method of manufacturing the same, particularly, to a blanket for an offset printing used in a gapless offset rotary press and a method of manufacturing the same.

FIG. 1 exemplifies a conventional offset rotary press. As shown in the drawing, the press comprises a pair of blanket cylinders 2, 2 having a roll paper (web paper, printing paper sheet) 1 held therebetween, plate cylinders 3, 3 arranged in contact with the blanket cylinders 2, 2, respectively, inking arrangements 4, 4 for supplying an ink to these plate cylinders 3, 3, respectively, and dampening water units 5, 5. The ink is transferred onto the printing paper sheet held between the blanket cylinders 2, 2.

In the offset press of the construction described above, a sheet-type blanket 6 is wound about the blanket cylinder 2, and the both end portions of the blanket 6 are inserted into a gap 7 and fixed by fastening with a fastening tool 8, as shown in FIG. 2. The plate cylinder 3 arranged in contact with the blanket cylinder 2 is also provided with the gap 7.

It should be noted that, in the offset rotary press of the particular construction, printing is not performed in the gap portion of the printing paper sheet. After the printing operation, the gap portion is cut away and discarded. Also, if these blanket cylinder 2 and the plate cylinder 3 are rotated at a high speed, an impact or vibration is generated in the gap portion so as to give rise to dotted slurs (deformation of dotted points in the rotating direction) in the print, thereby making the print defective.

To overcome the above-noted defects, a gapless offset rotary press using a cylindrical blanket has been proposed in, for example, Japanese Patent No. 2569213 and Japanese Patent No. 2519225 (U.S. Pat. No. 4,913,048). Several proposals have also been made in respect of the cylindrical blanket (tubular blanket) used in these gapless offset presses in, for example, Japanese Patent Disclosure (Kokai) No. 5-301483, Japanese Patent Disclosure No. 8-216548, Japanese Patent Disclosure No. 7-1857, Japanese Patent Disclosure No. 7-1858 and Japanese Patent Disclosure No. 6-340187.

These cylindrical blankets have been proposed on the basis of the conventional technique of the sheet-type blanket, and the problems inherent in the conventional sheet-type blanket remain unsolved in the cylindrical blanket. The most serious problem to be noted is that the printed surface is rendered defective by the reduction in the thickness of the cylindrical blanket (sinking), which takes place during use of the cylindrical blanket. In other words, the thickness reduction (sinking) causes the printing pressure to be lowered so as to render the printed surface defective.

An additional problem to be noted is that fine lines arranged immediately below a printing surface rubber are reproduced on the printed surface in the form of a pattern consisting of differences in thickness of the ink. In general, the cylindrical blanket consists of a laminate structure including a nickel sleeve having a predetermined diameter and a thickness of about 0.15 mm, a solid rubber base layer bonded directly to the surface of the nickel sleeve with an adhesive, a compressible porous rubber layer formed on the base layer, an inextensible layer prepared by winding threads or filaments about the compressible porous rubber layer, and a surface rubber layer formed on the inextensible layer.

The gapless offset rotary press is mainly intended to reduce the printing cost by markedly increasing the printing rate by a high speed rotation and, thus, is required to achieve a high working rate. Naturally, the cylindrical blanket is required to exhibit a stability higher than that in the conventional sheet-type blanket. It should be noted in this connection that, where thickness reduction takes place in the conventional sheet-type blanket, it is impossible to re-use the blanket unless the underlying plastic film is replaced by a thicker one. In the cylindrical blanket, however, the blanket is formed integral with the support body of the sleeve, making it impossible to replace the rubber layer alone. It follows that the thickness reduction in question makes it impossible to repair the cylindrical blanket so as to be used again.

In the sheet-type blanket, plain weave fabric is used as an inextensible layer. In the cylindrical blanket, however, an inextensible layer prepared by continuously winding a thread or a filament is arranged between the compressible layer and the surface rubber layer. Also, the thread used for forming the inextensible layer consists of a cotton thread or a synthetic thread having a diameter of 0.1 to 0.5 mm. The particular thread is helically wound from one end of the sleeve to form the inextensible layer.

A serious problem inherent in the cylindrical blanket thus prepared is that, since the printing speed of the gapless offset press using the cylindrical blanket is markedly higher than that for the conven- tional offset web press so as to increase the printing productivity, the thickness reduction is brought about promptly in the cylindrical blanket to make the cylindrical blanket unusable in a shorter time, compared with the conventional sheet-type blanket. Also, a striped irregularity is formed on the surface rubber layer, and a striped pattern consisting of differences in thickness of the ink and conforming with the striped irregularity on the surface rubber layer is formed on the printed paper sheet to make the printing unsatisfactory.

BRIEF SUMMARY OF THE INVENTION

An object of the present invention is to provide a blanket for an offset printing, in which an inextensible layer is formed by winding a thread that is compressed in advance to 90% to 50% of the original thickness about a compressible layer so as to prevent the thickness of the blanket from being reduced with time, to prevent the printed paper sheet from bearing an uneven thickness of the printed ink caused by the presence of the inextensible layer made of the thread and, thus, to improve the life of the blanket.

Another object of the present invention is to provide a method of manufacturing a blanket for an offset printing, in which an inextensible layer is formed by winding a thread that is compressed in advance to 90% to 50% of the original thickness about a compressible layer so as to prevent the thickness of the blanket from being reduced with time, to prevent the printed paper sheet from bearing an uneven thickness of the printed ink caused by the presence of the inextensible layer made of the thread and, thus, to improve the life of the blanket.

According to an aspect of the present invention, there is provided a blanket for an offset printing, the blanket consisting of a metallic sleeve, a base layer in direct contact with the metallic sleeve, a compressible rubber layer formed on the base layer, an inextensible layer formed on the compressible rubber layer, and a surface rubber layer, wherein the inextensible layer consists of a thread that is compressed in advance to 90% to 50% of the original thickness and about the compressible layer.

According to another aspect of the present invention, there is provided a method for manufacturing a blanket for an offset printing, the blanket consisting of a metallic sleeve, a base layer in direct contact with the metallic sleeve, a compressible rubber layer formed on the base layer, an inextensible layer formed on the compressible rubber layer, and a surface rubber layer, wherein the inextensible layer is formed by winding a thread that is compressed in advance to 90% to 50% of the original thickness about the compressible layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve-to explain the principles of the invention.

DETAILED DESCRIPTION OF THE PRESENT INVENTION

The present inventors have observed and studied in detail a used cylindrical blanket in an attempt to locate the causes of the two inconveniences described above, i.e., the reduction in thickness of the blanket and the striped uneven thickness of the ink on the printed paper sheet, arriving at the present invention.

Figure 1:
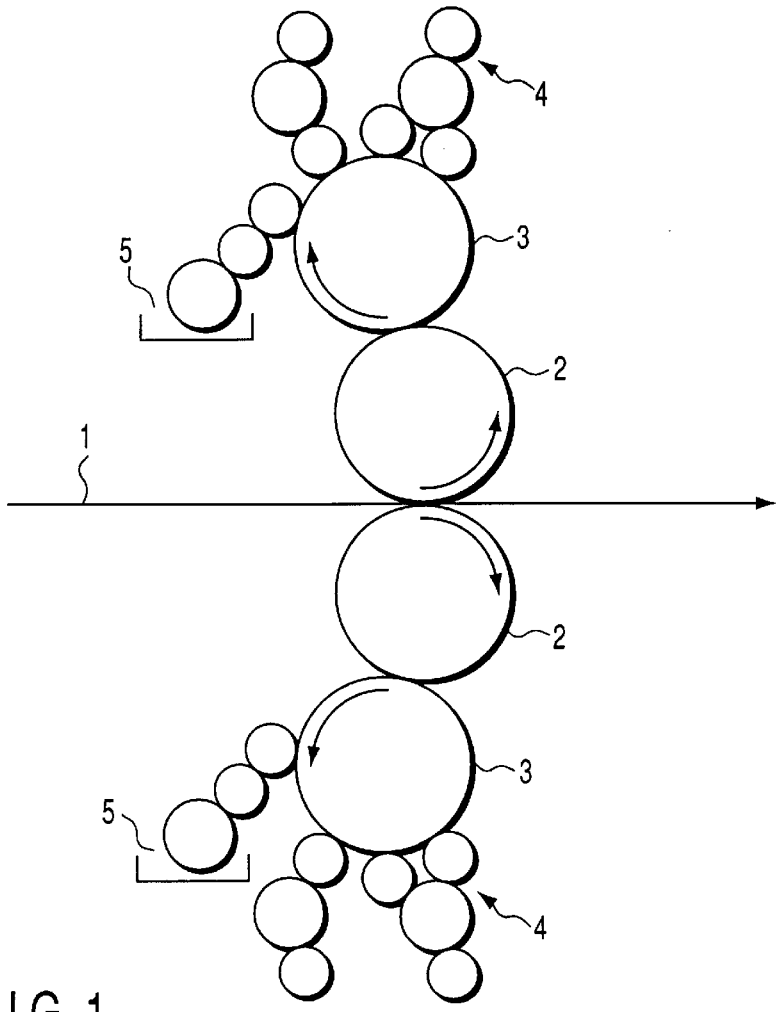
FIG. 1 PRIOR ART
FIG. 1 schematically shows the concept of an offset rotary press.
Figure 2:
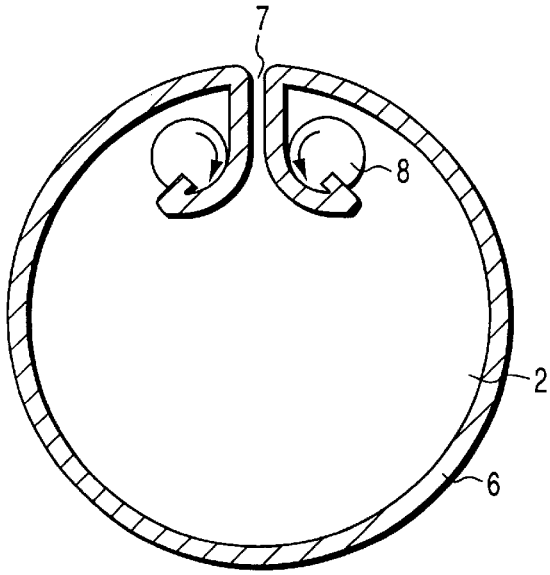
FIG. 2 PRIOR ART
FIG. 2 shows a gap portion included in the offset press shown in FIG. 1.
Figure 3A:
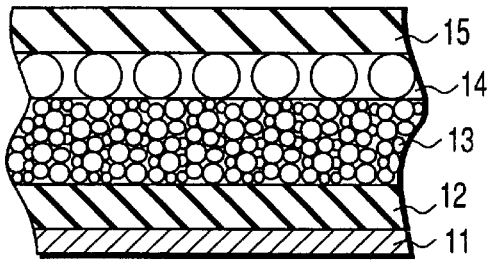
FIG. 3A PRIOR ART
FIGS. 3A and 3B collectively show a gist portion of the conventional cylindrical blanket.
Figure 3B:
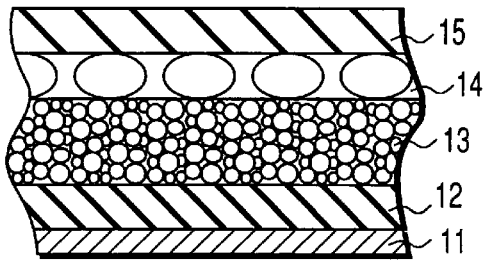
FIG. 3B PRIOR ART

It has been found that the used cylindrical blanket is thinner by 0.1 to 0.15 mm than the blanket before use. Specifically, the used blanket and the blanket before use were actually observed microscopically. When it comes to the blanket before use, the cross section of the thread forming the inextensible layer was found to be substantially circular, as shown in FIG. 3A. On the other hand, the cross section of the thread included in the used blanket was found to have been collapsed to form an elliptical shape, as shown in FIG. 3B. Incidentally, in FIGS. 3A and 3B, the blanket comprises a nickel sleeve 11. Formed on the surface of the nickel sleeve 11 are a base layer 12, a compressible layer 13, an inextensible layer 14 and a surface rubber layer 15. It has also been found that the striped unevenness in the thickness of the ink on the printed paper sheet conforms with the clearances formed between adjacent turns of the thread. It is considered reasonable to understand that the unevenness in the thickness of the ink is derived from the difference in the printing pressure between the thread portion collapsed to have a high hardness and the rubber portion between adjacent turns of the thread.

Incidentally, in the conventional sheet-type blanket, in which plain weave fabric is used as the inextensible layer, these problems are not considered to take place.

In the present invention, a single yarn or a multiply yarn consisting of either a natural fiber such as cotton, hemp, silk or rayon, or a synthetic fiber such as polyester, nylon, polyamide, polyimide or aramid polyacrylate is used as the thread forming the inextensible layer.

The material used for forming the compressible rubber layer and the surface rubber layer included in the blanket of the present invention includes, for example, acrylonitrile rubber, butadiene rubber, hydrogenated nitrile rubber, chloroprene rubber, silicone rubber, fluorosilicone rubber, epichlorohydrin rubber, natural rubber, butyl rubber, fluororubber, ethylene-propylene rubber, isoprene rubber, urethane rubber, and styrene-butadiene rubber. These rubbers can be used singly or in the form of a mixture thereof.

In the present invention, the thread used for forming the inextensible layer is compressed in advance to 90 to 50% of the original thickness. In other words, the compression rate is 10 to 50%. If the compression rate is lower than 10%, it is impossible to compress the thread sufficiently. As a result, the thickness of the blanket is reduced during use of the blanket. On the other hand, if the compression rate is higher than 50%, the thread is damaged, leading to decrease in mechanical strength of the thread. Needless to say, where the thread having a thickness (cross section) of, for example, 0.4 mm is compressed to 90% to 50% of the original thickness, the compressed thread has a thickness of 0.36 mm (90%) to 0.2 mm (50%).

Figure 4:
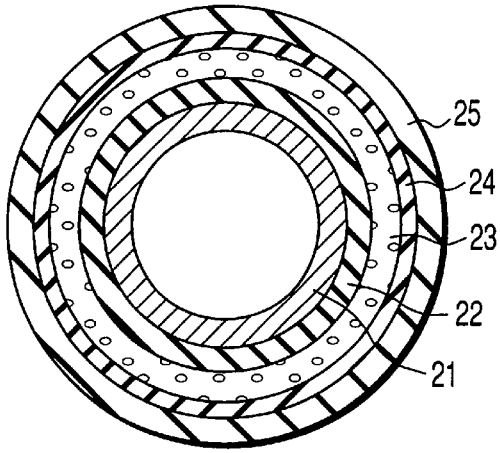
FIG. 4 is a cross sectional view showing a blanket according to one embodiment of the present invention for an offset printing.

FIG. 4 is a cross sectional view showing a blanket for an offset printing according to one embodiment of the present invention. As shown in the drawing, the blanket includes a nickel sleeve (support member) 21. Formed on the outer circumferential surface of the nickel sleeve 21 are a base layer 22, a compressible layer 23, an inextensible layer 24 and a surface rubber 25.

Figure 5A:
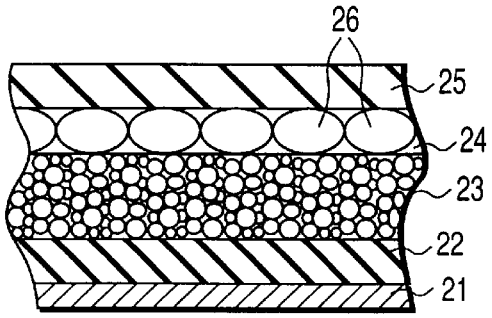
FIGS. 5A and 5B collectively show a gist portion of the cylindrical blanket shown in FIG. 4.
Figure 5B:
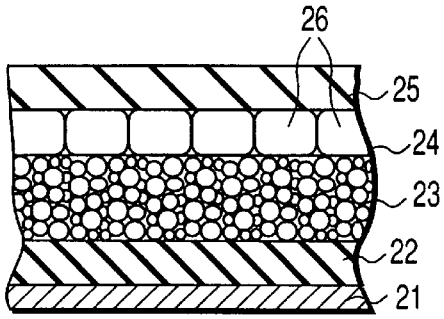

FIGS. 5A and 5B collectively show a gist portion of the blanket shown in FIG. 4. It should be noted that a thread 26 constituting the inextensible layer 24 is compressed in advance to 90 to 50% of the original thickness to have an elliptical cross sectional shape as shown in FIG. 5A or to have a rectangular cross sectional shape as shown in FIG. 5B. As apparent from the drawings, the thread 26 constituting the inextensible layer 24 is not compressed even after use of the blanket. Naturally, the thickness of the inextensible layer remains substantially constant regardless of use of the blanket. In other words, the thickness reduction of the inextensible layer 24 can be suppressed substantially completely. It is also possible to prevent a striped unevenness in the thickness of the ink on the printed paper sheet.

The blanket for offset printing constructed as described above is manufactured as follows:

1. In the first step, the base layer 22 consisting of a solid rubber is wound about the sleeve 21 with an adhesive (not shown) interposed between the sleeve 21 and the base layer 22. Alternatively, the sleeve 21 is coated in a predetermined thickness with a rubber paste by using a doctor blade. The thickness of the base layer 22 should be determined appropriately in view of the entire thickness of the blanket.

2. Then, the compressible layer 23 is formed on the base layer 22. The compressible layer 23 can be formed by any of known methods (a) to (c) given below:

(a) Preparation of sponge rubber using a foaming agent (foaming method);

(b) Preparation of sponge rubber by utilizing leaching of a water-soluble salt; and (c) Preparation of sponge rubber by using thermoplastic microballoons.

In short, the base layer 22 is coated in a predetermined thickness with a rubber paste forming the compressible layer 23 by using a doctor blade.

3. Then, the resultant structure is introduced into an autoclave set at 110 to 140° C. for heating the compressible layer 23 for 3 to 5 hours so as to carry out vulcanization and sponge formation. In the case of the salt leaching method, the compressible layer 23 is dipped in a warm water for removing salts and perform the sponge formation, followed by forming the inextensible layer 24 on the compressible layer 23. In this step, a thread is compressed first to have its thickness (or cross sectional area) reduced to 90 to 50% of the original thickness such that the compressed thread has an elliptical or rectangular cross sectional shape, followed by helically winding the compressed thread about the compressible layer 23 to form the inextensible layer 24. In forming the inextensible layer 24, it is possible to allow an adhesive to permeate into the thread before the compressing step. In this case, the cross sectional shape of the compressed thread can be fixed at an elliptical or rectangular shape.

As a result, the thread can be wound such that no clearance is provided between adjacent turns of the wound thread. In other words, the adjacent turns of the wound thread are rendered contiguous to each other so as to present an outer appearance that the inextensible layer 24 consists of a single piece of cloth. The pressure for compressing the thread can be determined appropriately in view of the kind of the thread, i.e., twist strength, single yarn, two ply yarn, three ply yarn, four-folded yarn, five-folded yarn, etc.

Figure 6:
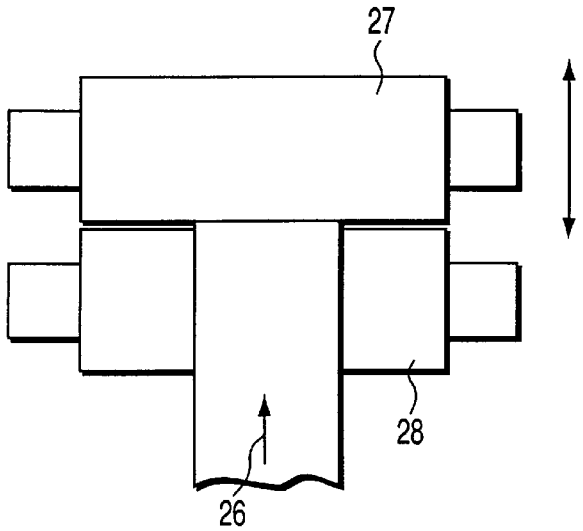
FIG. 6 illustrates a method of compressing the thread used for preparing an inextensible layer included in the blanket for offset printing shown in FIG. 4.
Figure 7:
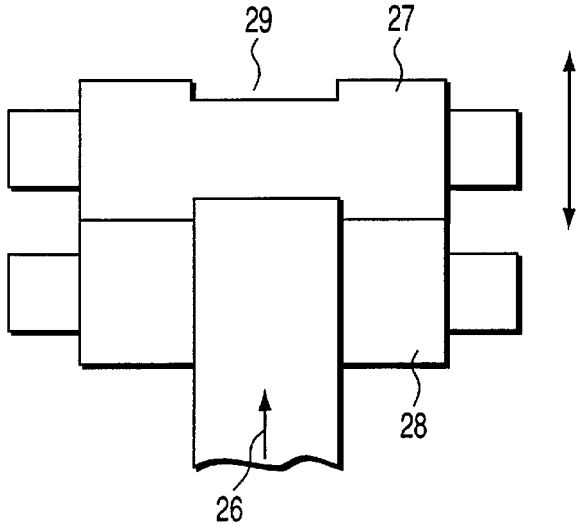
FIG. 7 illustrates another method of compressing the thread used for preparing an inextensible layer included in the blanket for offset printing shown in FIG. 4.

Each of FIGS. 6 and 7 shows the compressing means of a thread. In the compressing means shown in FIG. 6, a thread 26 is passed through a clearance between two miniature calender rolls 27 and 28 each formed of a metallic material, a ceramic material or resin. In this case, the compressed thread bears an elliptical cross sectional shape. In the compressing means shown in FIG. 7, a groove 29 is formed in the miniature calender roll 27 to determine in advance the amount of compression of the thread 26, and the thread 26 is passed through the groove 29. In this case, the compressed thread bears a rectangular cross sectional shape.

The present invention will now be described with reference an Example of the present invention and a Comparative Example.

EXAMPLE 1

A nickel sleeve having a thickness of 0.15 mm, an outer diameter of 170 mm and a length of 710 mm was fitted over a working mandrel (air cylinder), followed by uniformly coating the outer circumferential surface of the nickel sleeve with "Metalock NT" (trade name of an adhesive manufactured by Toyo Kagaku Kenkyusho K. K.). Then, a rubber compound prepared by mixing a composition shown in Table 1 below with an open roll was formed into a sheet having a thickness of 0.1 mm by using a calender roll. The sheet thus prepared was wound on the sleeve in a thickness of 0.5 mm so as to form a base layer on the nickel sleeve.

TABLE 1

| Composition | Mixing amount (parts by weight) |
|---|---|
| Nitrile rubber (trade name: JSRN-230SH, manufactured by JRS Inc.) | 100 |
| Sulfur | 2 |
| Zinc oxide | 5 |
| Stearic acid | 1 |
| Dibenzothiazyl sulfide (trade name: Nocceler DM, manufactured by Ohuchi Shinko Kagaku K.K.) | 1 |
| Zinc dimethyl dithio carbamate (trade name: Nocceler PZ, manufactured by Ohuchi Shinko Kagaku K.K.) | 1 |
| 2,6-di-tert-butyl-4-methyl phenol (trade name: Nocrack 200, manufactured by Ohuchi Shinko Kagaku K.K.) | 1 |
| Carbon black | 30 |
| Calcium carbonate | 20 |
| Dioctyl phthalate (DOP, softening agent) | 10 |
| Sum | 171 |

(Shore A hardness 65 °)

Then, a rubber paste having a viscosity of 1500 poises was prepared by mixing in an open roll a composition given in Table 2 below, followed by dissolving the mixed compound in toluene. As shown in Table 2, the composition contained "Matsumoto Microsphere-F-50" (trade name of vinylidene chloride series thermoplastic microballoons manufactured by Matsumoto Yushi K. K.). The thermoplastic microballoons are expanded when heated so as to convert the rubber compound into sponge and, thus, to form a compressible layer. Then, a doctor blade was arranged to form a small clearance between the tip of the doctor blade and the surface of the base layer. Under this condition, the rubber paste of the composition shown in Table 2 was put on the doctor blade, and the working mandrel was rotated by a rotating means so as to coat the surface of the base layer with the rubber paste in a thickness of 0.4 mm.

TABLE 2

| Composition | Mixing amount (parts by weight) |
|---|---|
| Nitrile rubber (trade name: Nipol 1032, manufactured by Nippon Zeon Inc.) | 100 |
| Sulfur | 2 |
| Zinc oxide | 5 |
| Stearic acid | 1 |
| Nocceler DM | 1 |
| Nocceler PZ | 1 |
| Nocrack 200 | 1 |
| Carbon black | 20 |
| Calcium carbonate | 20 |

TABLE 2-continued

| Composition | Mixing amount (parts by weight) |
|---|---|
| Dioctyl phthalate (DOP) | 15 |
| Microballoon (trade name: Matsumoto microsphere-F-50, manufactured by Matsumoto Yushi K.K.) | 10 |
| Sum | 176 |

Figure 8:
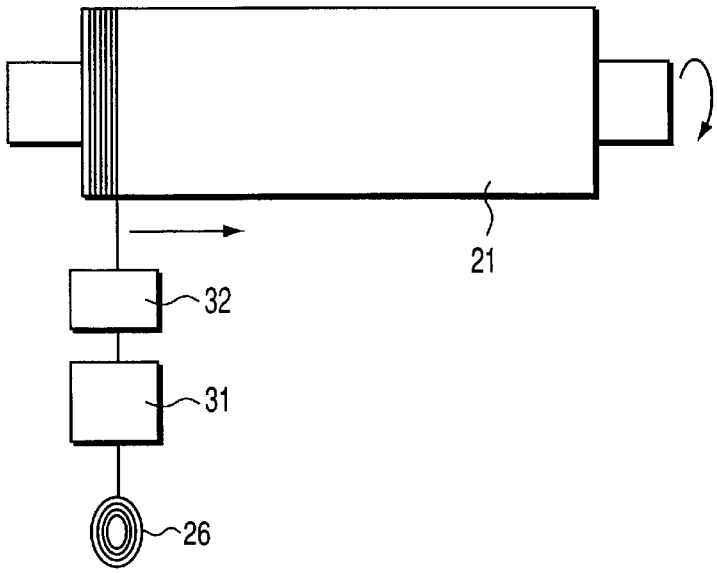
FIG. 8 shows an apparatus for compressing and winding a thread coated with an adhesive layer about a compressible layer for preparing an inextensible layer included in the blanket of the present invention for the offset printing.

Then, toluene was evaporated, followed by heating the rubber paste layer for 4 hours within an autoclave set at 110° C. so as to achieve vulcanization and expansion of the microballoons and, thus, to prepare a compressible layer. Further, the compressible layer was ground by a grinding machine to have an outer diameter of 171.6 mm, followed by mounting the working mandrel to a carriage. The thread 26 wound to a moving device (not shown) and the miniature calender device 32 for compressing the thread 26 as shown in FIG. 6 or 7, and a rubber paste vessel 31 for allowing the rubber paste to permeate into the thread 26 are arranged in front of one end portion of the working mandrel, as shown in FIG. 8.

A three-ply cotton thread having a thickness of 0.4 mm was passed through the rubber paste vessel 31 to permit the rubber paste to permeate into the cotton thread, followed by compressing the thread by the calender device 32 to have a thickness of 0.27 mm. The compressed thread was continuously wound about the compressible layer starting with one end of the compressible layer by rotating the working mandrel while moving the carriage having the thread 26 mounted thereto in a direction parallel to the axis of the working mandrel so as to form an inextensible layer. In this step, the cotton thread was compressed to have a thickness of 0.13 mm. Also, the moving speed of the carriage having the thread mounted thereto and the rotating speed of the working mandrel were controlled to allow the adjacent turns of the thread 26 wound about the compressible layer to be substantially contiguous to each other. Incidentally, the number of turns of the wound thread per centimeter of the resultant inextensible layer in the axial direction of the working mandrel was set at 20.

In the next step, the carriage of the thread 26 was detached, and a doctor blade was arranged such that a small clearance was formed between the tip of the doctor blade and the surface of the inextensible layer, followed by putting the rubber paste of the composition shown in Table 1 on the doctor blade. Under this condition, the working mandrel was rotated so as to coat the inextensible layer with the rubber paste in a thickness of 0.1 mm, followed by further coating in this fashion the rubber paste layer with a rubber paste of the composition shown in Table 3 in a thickness of 0.5 mm so as to form a surface rubber layer. Further, the surface rubber layer of the laminate structure was dried at 50 to 60° C. for 24 hours, followed by introducing the working mandrel into an oven, vulcanizer set at 140° C. so as to carry out vulcanization for 5 hours. After completion of the vulcanizing treatment, the surface rubber layer was cooled and, then, polished by a grinding machine to have an outer diameter of 172.94 mm. The surface roughness Rz was set at 5 to 6 $\mu$m. Finally, air was blown under pressure into the working mandrel from the side surface of the working mandrel so as to withdraw the product cylindrical blanket from the working mandrel.

Eight cylindrical blankets were similarly prepared. Each of these cylindrical blankets was mounted to a gapless rotary press (B/B type four color press) so as to carry out printing of 10,000,000 rotations at a speed of 1000 m/min. After the printing operation, the printing quality (namely; dot reproduction and solid coverage) was found satisfactory and the thickness reduction of the blanket was found to be only 0.02 mm. Therefore, the printing was further continued. The thickness reduction of the blanket after 30,000,000 rotations was found to be only 0.03 mm, and the printing quality was found to be satisfactory. Further, a patterned uneven thickness of the printed ink caused by the presence of the inextensible layer made of the thread was not found on the printed paper sheet, and it was possible to further continue the printing for an additional 10,000,000 rotations.

TABLE 3

| Composition | Mixing amount (parts by weight) |
|---|---|
| Nitrile rubber (trade name: JSRN-230SH, manufactured by JRS Inc.) | 100 |
| Polysulfide rubber (trade name: LP-2, manufactured by | 7 |
| Sulfur | 2 |
| Zinc oxide | 5 |
| Nocceler DM | 1 |
| Nocceler PZ | 1 |
| Nocrack 200 | 1 |
| Stearic acid | 1 |
| Calcium carbonate | 20 |
| Silica (trade name: Nip sil VN-3, manufactured by Nippon Silica K.K.) | 20 |
| Dioctyl phthalate (DOP) | 10 |
| Blue pigment | 2 |
| Sum | 170 |

(Shore A hardness 51 °)

In the Example described above, the inextensible layer 24 was prepared by winding the thread 26 about the outer surface of the compressible layer 23 such that the adjacent turns of the wound thread was contiguous to each other. In addition, the thread was compressed before the winding to 90 to 50% of the original thickness. The particular construction made it possible to prevent the thickness reduction of the cylindrical blanket after the printing operation and to prevent occurrence of a patterned uneven thickness of the printed ink caused by the presence of the inextensible layer made of the thread on the printed paper sheet. It follows that the present invention permits obtaining a blanket for offset printing having a long life.

Comparative Example

A cylindrical blanket was prepared as in the Example of the present invention described above, except that a cotton thread having a thickness of 0.4 mm was not compressed in the step of forming the inextensible layer. The cylindrical blanket thus prepared was mounted to a gapless offset web press, and printing was performed at a speed of 1000 m/min. It has been found that reduction in the solid density and a patterned uneven thickness of the printed ink caused by the presence of the inextensible layer made of the thread had come to attract attentions at 10,000,000 rotations. The thickness reduction of the cylindrical blanket was found to be as large as 0.1 mm. Also, it was barely possible to perform the printing at 15,000,000 rotations.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A blanket for an offset printing, comprising a metallic sleeve, a base layer formed on said metallic sleeve, a compressible rubber layer formed on the base layer, an inextensible layer formed on said compressible rubber layer, and a surface rubber layer formed on said inextensible layer, wherein said inextensible layer consists of a thread that is compressed in advance to 90% to 50% of the original thickness and wound about said compressible layer.

2. A blanket for offset printing according to claim 1, wherein said inextensible layer is formed of a thread selected from the group consisting of a single yarn or a multi ply yarn of a natural fiber including a cotton fiber, a hemp fiber, a silk fiber and rayon, and a synthetic fiber including a polyester fiber, a nylon fiber, a polyamide fiber, a polyimide fiber and an aramid polyacrylate fiber.

3. A blanket for offset printing according to claim 1, wherein each of said compressible rubber layer and said surface rubber layer is formed of a material selected from the group consisting of acrylonitrile-butadiene rubber, hydrogenated nitrile rubber, chloroprene rubber, silicone rubber, fluorosilicone rubber, epichlorohydrin rubber, natural rubber, butyl rubber, fluororubber, ethylene-propylene rubber, isoprene rubber, urethane rubber, styrene-butadiene rubber, and a mixture thereof.

4. A method of manufacturing a blanket for an offset printing, comprising a metallic sleeve, a base layer formed on said metallic sleeve, a compressible rubber layer formed on the base layer, an inextensible layer formed on said compressible rubber layer, and a surface rubber layer formed on said inextensible layer, wherein said inextensible layer is formed by winding a thread that is compressed in advance to 90% to 50% of the original thickness about said compressible layer.

5. A method of manufacturing a blanket for offset printing according to claim 4, wherein said inextensible layer is formed of a thread selected from the group consisting of a singe yarn or multi ply yarn of a natural fiber including a cotton fiber, a hemp fiber, a silk fiber and rayon, and a synthetic fiber including a polyester fiber, a nylon fiber, a polyamide fiber, a polyimide fiber and an aramid polyacrylate fiber.

6. A method of manufacturing a blanket for offset printing according to claim 4, wherein each of said compressible rubber layer and said surface rubber layer is formed of a material selected from the group consisting of acrylonitrile-butadiene rubber, hydrogenated nitrile rubber, chloroprene rubber, silicone rubber, fluorosilicone rubber, epichlorohydrin rubber, natural rubber, butyl rubber, fluororubber, ethylene-propylene rubber, isoprene rubber, urethane rubber, styrene-butadiene rubber, and a mixture thereof.

7. A method of manufacturing a blanket for offset printing according to claim 4, wherein said thread is impregnated with an adhesive and, then, wound about said compressible layer for forming said inextensible layer.

* * * * *